United States Patent [19]

Wang

[11] Patent Number: 4,547,919

[45] Date of Patent: Oct. 22, 1985

[54] INFLATABLE ARTICLE WITH REFORMING AND REINFORCING STRUCTURE

[76] Inventor: Cheng-Chung Wang, 7th Fl., No. 37, An-Ho Rd., Taipei, Taiwan

[21] Appl. No.: 467,546

[22] Filed: Feb. 17, 1983

[51] Int. Cl.[4] ..... A47C 27/08; A41D 13/10; F41H 1/04

[52] U.S. Cl. ..... 5/455; 2/18; 2/413; 2/DIG. 3; 4/499; 4/506; 4/588; 297/DIG. 3; 441/40

[58] Field of Search ..... 5/455, 449, 441, 457, 5/458; 383/3; 297/DIG. 3; 2/18, 413, DIG. 3; 4/588, 488, 499, 500; 52/23; 441/40, 129

[56] References Cited

U.S. PATENT DOCUMENTS

| | | | |
|---|---|---|---|
| 3,030,640 | 4/1962 | Gosman | 5/455 |
| 3,780,388 | 12/1973 | Thomas et al. | 297/DIG. 3 |
| 4,150,447 | 4/1979 | Miller | 5/455 |

*Primary Examiner*—Alexander Grosz
*Attorney, Agent, or Firm*—McGlew and Tuttle

[57] ABSTRACT

An inflatable article, having a pair of gas impervious sheets which are heat welded together at their edges to form an envelope and are provided with parallelly spaced apart longitudinal first seams to define a plurality of air compartments between the pair of sheets, is provided with a reforming and reinforcing outer inflatable multiple-compartmented unit formed, on the wall of the envelope, by heat-sealing an additional outer sheet to one of the pair of gas impervious sheets at the edge portions and at the lines which lie between each two of the first longitudinal seams to form second seams whereby the article will achieve a stronger and stiffer construction and the acute fused edge portions thereof can be reformed by the expanded superimposed inflatable outer units adjacent to the edge portions.

2 Claims, 13 Drawing Figures

INFLATABLE ARTICLE WITH REFORMING AND REINFORCING STRUCTURE

BACKGROUND OF THE INVENTION

This invention relates to inflatable plastic sheeting articles having multiple air compartments, such as, air mattresses, floats and the like, and particularly to those having reforming and reinforcing, inflatable units formed by additional outer sheets which are superimposed on and sealed to the main inflatable bodies thereof.

Inflatable articles, such as, air mattresses, floats, in the past, are made of two gas impervious sheets a and b which are joined together at their edges by heat sealing and provided with parallelly spaced apart longitudinally heat welded seams c in the area bounded by the edge seams to form adjacent air passages or compartments as shown in FIG. 1. This type of construction has less stiffness so that it has a tendency to deform or curve other than flat after inflation and also the sheeting at the seams is liable to tear. Furthermore, when it is inflated, it can not exhibit a neat configuration as the seam portions are apparently lower in position than other portions. One of the improvements is made by providing inner membranes e which are sealed to the inner sides of the two sheets for defining the air compartments as shown in FIG. 2. Nevertheless, the provision of such membranes may creates a complication in porcessing.

The manufacture of inflatable plastic sheeting articles having exteriorly formed inflatable portions superimposed on the inflatable main bodies are well known in the art. In U.S. Pat. No. 2,170,539, there is disclosed a toy ballon of irregular shape having sunken portions and projecting portions, the projecting portions being independently formed and superimposed on the main inflatable body of the toy ballon for providing an amount of rigidity of the projecting portions so that these portions can be retained in their desired shape. U.S. Pat. No. 1,851,768 discloses water toys which are provided with inflatable projecting portions at the lower parts thereof for floating the toys in the upright positions. In both patents, there is only disclosed inflatable projecting portions formed at certain parts on the wall of the main inflatable body. These projecting portions are not multiple-compartmented and are not necessarily formed at the edge portion or throughout the whole construction of the main inflatable body.

SUMMARY OF THE INVENTION

An object of the invention is to provide a multiple-compartmented inflatable articles, such as, air mattresses, floats and the like, with reforming and reinforcing, multiple-compartmented inflatable units which are formed on the wall of the main inflatable body for increasing the stiffness and strength of the construction thereof.

Another object of the invention is to provide a method of constructing an inflatable article to increase tne stiffness and strength of the inflatable article, such as the inflatable frame of an inflatable pool which must support or hold a load, so that it will not deform even if it is constructed in a relatively large size.

A further object of the invention is to provide an outer inflatable unit which can reform the acute fused edge portion of an inflatable article and is formed by heat sealing an additional outer gas impervious sheet to, near or at the acute fused edge portion of the article to form an outer inflatable unit to expand over the acute edge portion so as to hide it therebeneath.

According to one aspect of the present invention, a method of manufacturing an inflatable article comprises the steps of, joining a pair of first gas impervious sheets together by heat-seal at their edges to form an envelope, providing parallelly spaced apart longitudinal seams on the gas impervious sheets by heat-seal to define a plurality of first air compartments between the pair of sheets, spreading at least one outer second sheet of the same material on at least one of the pair of gas impervious sheets, and heat sealing them together at the edges of the envelope and at longitudinal lines which lie between each two of the first longitudinal seams to form second longitudinal seams defining a plurality of second air compartments superimposed on the envelope, whereby the second air compartments will reform the portions at which the first longitudinal seams exist and the article will achieve a strong and stiff construction.

According to another aspect of the invention, an inflatable article comprises, at least two first gas impervious sheets joined together by heat-seal to form an envelope having an acute sealed edge portion, at least one outer second gas impervious sheet superimposed on and sealed to at least one of the first gas impervious sheets near and along the acute sealed edge portion to form an outer inflatable reforming unit, the outer inflatable reforming unit being expanded over the acute sealed edge portion so as to hide it therebeneath, and valve means for inflating the envelope and the outer inflatable reforming unit.

The manner in which the above and related objects is accomplished together with the attending advantages and features of the invention will appear more fully from the following detailed description and drawings.

DETAILED DESCRIPTION OF THE PREFERRED EMBODIMENTS

Figure 1:
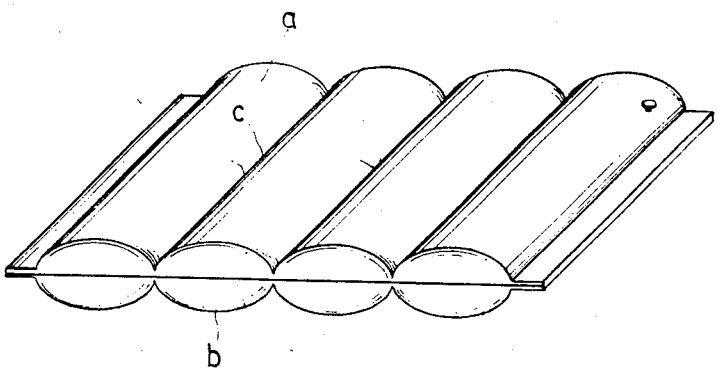
FIG. 1 PRIOR ART
FIG. 1, is a sectioned perspective view of an inflatable article in the prior art.
Figure 2:
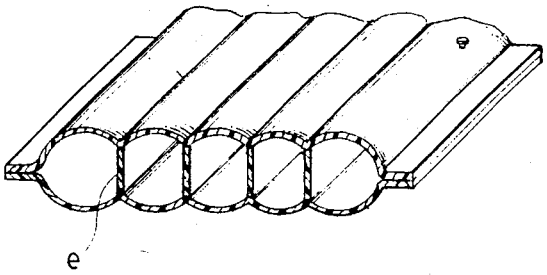
FIG. 2 PRIOR ART
FIG. 2, is a sectioned perspective view of another inflatable article in the prior art.
Figure 3:
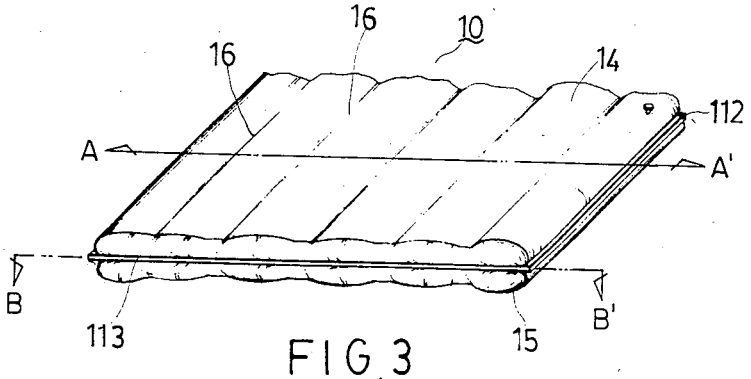
FIG. 3, is a perspective view of a first embodiment of the invention.
Figure 4:
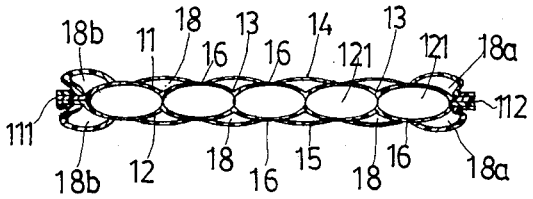
FIG. 4, is a sectioned view taken along the line A—A' of FIG. 3.
Figure 6:
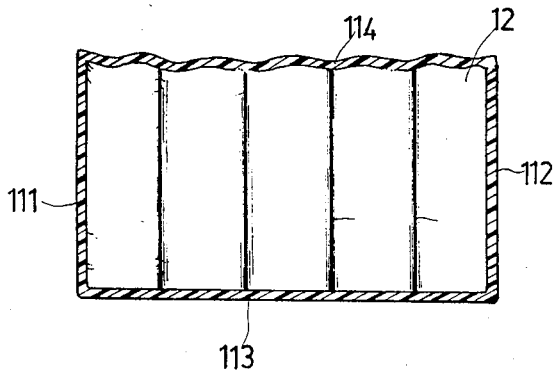
FIG. 6, is a sectioned view taken along the line B—B' of FIG. 3.

In the illustration of the first embodiment according to the invention, an inflatable article 10 is comprised of two base sheets 11 and 12 as shown in FIGS. 3 and 4 which are made of a gas impervious sheeting material and heat-sealed together at the edge portions 111, 112, 113 and 114 thereof to form an envelope and are provided with parallelly space apart longitudinal seams 13 extending from the fused edge 113 to the opposing fused edge 114 by heatseal to form a plurality of air compartments 121 as shown in FIGS. 4 and 6.

As embodied herein, there is further provided two outer sheets 14 and 15 which are made of a gas impervious sheeting material and are spread over the sheets 11 and 12 respectively. The sheets 14 and 15 are respectively heatsealed to the sheets 11 and 12 to form seams 16 which lie between each two longitudinal seams 13. Also, the edge portions of the sheets 14 and 15 are respectively heat sealed to the edge portions 111, 112, 113 and 114 of the sheets 11 and 12, thereby forming additional outer inflatable air compartments 18 on the walls of the envelope formed by the sheets 11 and 12. It can be noted that the air compartments 18, after inflated, reform or fill the depression caused by the seams 13 and provide a neat configuration of the article 10. It is appreciated that the air mattress and float usually has acute fused edge portions which are undesirable. These fused edge portions can be reformed by the additional outer inflatable air compartments. As seen in FIG. 4, the actute fused edge portions 111 and 112 of the article 10 is reformed and substantially covered by the inflated air compartments 18 which are adjacent thereto and specifically represented by 18*a* and 18*b* in FIG. 4. The portions that confine compartments 18*a* and 18*b* expand over the acute fused edge portions 111 and 112. For inflating the main envelope and outer air compartments 18, valve means can be provided on the sheets 14 or 15 as usually done in other inflatable articles and the compartments 121 and 18 have to be made so that they are communicated with each other by providing openings on the walls of the compartments.

Figure 5:
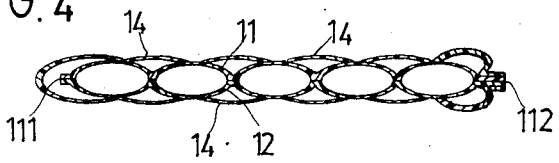
FIG. 5, is a sectioned view illustrating an alternative form of the first embodiment.

Alternatively, the additional outer inflatable units can be formed by using one additional sheet 14 i.e. a one piece sheet, spread over the sheet 11 and then folded to be spread over the sheet 12, instead of two additional sheets 14 and 15, as can be seen in FIG. 5. In this case the continuous seal free folded portion of the sheet 14 will wholly cover the fused edge portion 111 of the main envelope.

The above described reforming and reinforcing outer air compartments can be in successive layers one above the other, such as, two successive layers, three successive layers and so on. With the reforming and reinforcing structure, the article 10 will be improved to a strong and stiff construction and the seam portions and the acute fused edges thereof can be reformed to achieve a neat configuration.

Figure 7:
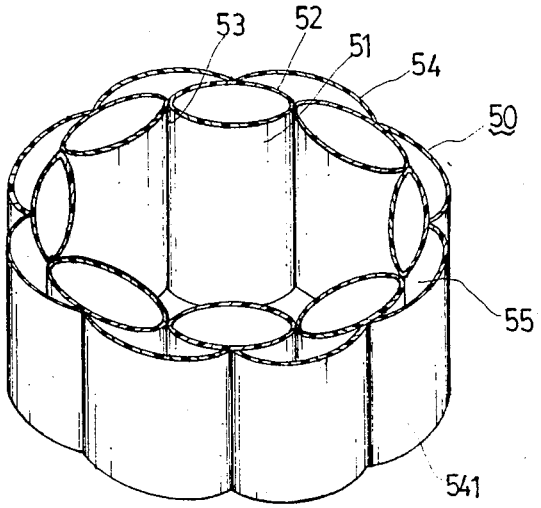
FIG. 7, is a schematic view of the second embodiment of the invention.

Referring to FIG. 7, there is provided a second embodiment in which a tubular shaped inflatable article 50 is comprised of two sheets of gas impervious sheeting material 51 and 52 which are sealed together at the upper and lower edges (not shown) and provided with longitudinal seams 53 by heat-seal. An outer sheeet 54 is provided around the periphery of the article 50 and is sealed to the sheet 52 to form seams 541 to define an outer inflatable unit having air compartments 55, thereby achieving a reforming and reinforcing result as in the case of the first embodiment. With the inflatable multiple compartmented outer unit, the tubular shaped article 50 will obtain a stronger and stiffer construction and accordingly it can resist deformation when subjected to a load even if it is in a large size. This type of construction can be used for the inflatable frame of inflatable articles, such as, inflatable pools which have to support or hold a load.

Figure 8:
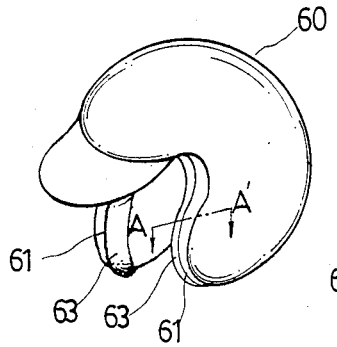
FIG. 8, is a schematic view of the third embodiment of the invention.
Figure 8A:
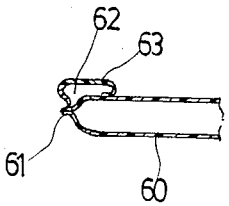
FIG. 8*a* is a fragmentary view taken along the line a—a of FIG. 8.

In the illustration of the third embodiment of the invention as shown in FIG. 8 and 8*a*, there is provided an inflatable helmet 60 which has an acute sealed edge 61 which will be adjacent to the face of the wearer when it is put on the head thereof. Along the seam 61 is provided a reforming inflatable unit 62 formed by an outer sheet 63 of which one end portion is sealed to the acute edge 61 and another end portion is sealed to the wall of the inflatable helmet near the acute edge 61. The inflatable unit 62 will expand over the acute edge 61 when inflated so that the edge 61 will be hidden under the reforming unit 62.

Figure 9:
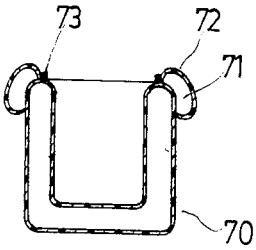
FIG. 9 is a schematic view of the fourth embodiment of the invention.

Referring to FIG. 9, there is shown a fourth embodiment in which a tank-shaped inflatable article 70 is provided with an inflatable lip portion 71 by heat sealing a longitudinal gas impervious sheet 72 around the edge portion of the tank shaped article 70. One end portion of the sheet 72 is sealed to the fused edge portion 73 and another end portion of the sheet 72 is sealed to the wall of the inflatable article 70 near the fused edge portion 73.

Figure 10:
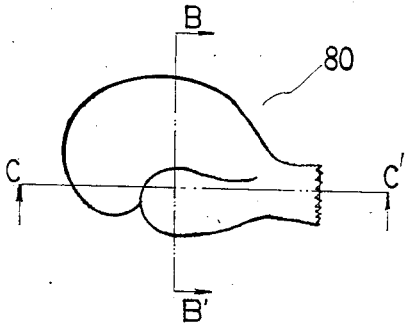
FIG. 10 is a schematic view of the fifth embodiment of the invention.
Figure 10A:
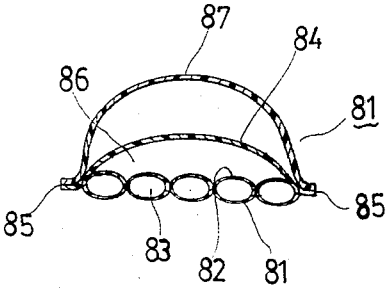
FIG. 10*a* is a sectioned view taken along the line b—b of FIG. 10.
Figure 10B:
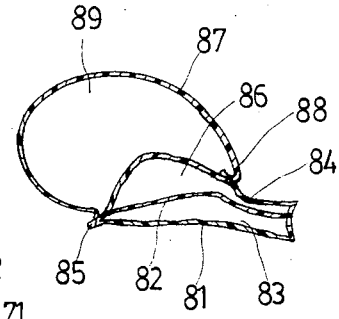
FIG. 10*b* is a sectioned view taken along the line c—c of FIG. 10.

Referring to FIGS. 10, 10*a* and 10*b*, and in the illustration of the fifth embodiment of the invention there is provided an inflatable boxing glove 80 made of two gas impervious sheets 81 and 82 which are properly sealed together to form a compartment 83 for receiving a hand. A further gas impervious sheet 84 is attached to the sheet 82 at the edge 85 to form an inflatable unit 86 for padding purposes and on the impervious sheet 84 is further provided a gas impervious sheet 87 which is sealed to the impervious sheet 84 at the fused edge portion 85 and seam 88 to form a further inflatable unit 89 to provide a thick cushioning layer for the fist.

With the invention thus explained, it is apparent that obvious modifications and variations can be made without departing from the scope of the invention. It is therefore intended that the invention be limited only as indicated in the appended claims.

I claim:

1. Inflatable article having at least one gas impervious first sheet formed into an inflatable envelope having opposed sides and which is provided with heat sealed edges and parallel spaced apart first longitudinal heat seal seams to form juxtaposed and structurally fixedly interconnected first elongate air compartments, and a second gas impervious one piece overlay sheet heat sealed to one side of said inflatable envelope along second longitudinal seams which lie parallel with and correspondingly between each adjacent two of said first seams to form second elongate air compartments juxtaposed and structurally fixedly interconnected with each other and correspondingly structurally fixedly interconnected with the adjacent said first compartments along said second seams, said second sheet having one continuous seal free portion thereof folded and extending over at least one said heat sealed edge and heat sealed to the other side of said inflatable envelope along corresponding third longitudinal seams opposite to said second seams.

2. Inflatable article having at least one gas impervious first sheet formed into an inflatable envelope having opposed sides and which is provided with heat sealed edges and parallel spaced apart first longitudinal heat seal seams to form juxtaposed first elongate air compartments, and gas impervious overlay sheet means including one sheet portion heat sealed to one side of said inflatable envelope along second longitudinal seams which lie parallel with and correspondingly between each two of said first seams to form second elongate air compartments juxtaposed with each other, and further including another sheet portion heat sealed to the other side of said inflatable envelope along third longitudinal seams which lie parallel with and correspondingly between each two of said first seams to form third elongate air compartments juxtaposed with each other, the corresponding second and third compartments adjacent at least one of said heat sealed edges being expandable upon inflation sufficiently for expanding over and hiding said at least one sealed edge thereat.

* * * * *